US006105838A

United States Patent [19]

Hansen

[11] Patent Number: 6,105,838

[45] **Date of Patent: *Aug. 22, 2000**

[54] HOLSTER AND BLADE WELL

[76] Inventor: Mary Kay Hansen, 586 Blackhawk Trail, Loveland, Ohio 45140

[ * ] Notice: This patent is subject to a terminal disclaimer.

[21] Appl. No.: 09/332,478

[22] Filed: Jun. 14, 1999

Related U.S. Application Data

[63] Continuation-in-part of application No. 09/057,744, Apr. 9, 1998, Pat. No. 6,000,590.

[51] Int. Cl.[7] ..... B26B 29/02

[52] U.S. Cl. ..... 224/232; 224/679; 224/680; 224/245; 224/904; 224/674; 224/666; 224/672; 206/359; 30/161

[58] Field of Search ..... 224/232, 233, 224/234, 678, 679, 680, 681, 242, 245, 673, 674, 671, 672, 666, 904; 206/352, 359; 30/124, 151, 162; 220/23.87, 528

[56] References Cited

U.S. PATENT DOCUMENTS

| | | | |
|---|---|---|---|
| 590,212 | 9/1897 | Daesch . | |
| 831,771 | 9/1906 | Bragg . | |
| 1,910,374 | 5/1933 | Williams . | |
| 2,054,080 | 9/1936 | Haynes . | |
| 3,857,176 | 12/1974 | Quenot . | |
| 4,063,356 | 12/1977 | Hepworth . | |
| 4,103,421 | 8/1978 | Quenot . | |
| 4,114,780 | 9/1978 | Sharon . | |
| 4,226,020 | 10/1980 | Quenot et al. . | |
| 4,395,807 | 8/1983 | Eldridge, Jr. et al. . | |
| 4,759,441 | 7/1988 | Leurek . | |
| 5,009,222 | 4/1991 | Her . | |
| 5,014,429 | 5/1991 | McNamara . | |
| 5,093,993 | 3/1992 | Nishiyama . | |
| 5,186,326 | 2/1993 | Peckels et al. . | |
| 5,388,741 | 2/1995 | Hillinger | 224/673 X |
| 5,505,356 | 4/1996 | Noriega | 224/681 X |
| 5,507,762 | 4/1996 | Abidin et al. . | |
| 5,568,888 | 10/1996 | Seber . | |
| 5,653,337 | 12/1999 | Cirigliano | 224/904 X |
| 6,000,590 | 12/1999 | Allen | 224/232 |

FOREIGN PATENT DOCUMENTS

| | | |
|---|---|---|
| 0395338 | 10/1990 | European Pat. Off. . |
| 0400800 | 12/1990 | European Pat. Off. . |
| 0700757 | 3/1997 | European Pat. Off. . |
| 3534627 | 4/1987 | Germany . |
| 4321520 | 1/1995 | Germany . |
| 380999 | 6/1940 | Italy . |

OTHER PUBLICATIONS

OLFA Corporation, Packaging and photo, OLFA Product, Model AB–10B (Date Unknown).

*More Blades,* Catalog Entry Listing Products and Prices (Date and Source Unknown).

Hyde Tools, *Snap Off Blades,* Packaging and photo (Date Unknown).

American Safety Razor Co., *Breakaway Knife,* Packaging and photo, Copyright 1994.

Red Devil, Inc., *Breakaway Blade Safety Dispenser,* Packaging and Photo, Red Devil (Date Unknown).

Red Devil, Inc., *Automatic Razor Knife,* Packaging and photos, Red Devil (Date Unknwon).

Stanley Tools, *Quick–Point Knife,* Packaging and photos, Stanley Tools Product, Copyright 1995.

(List continued on next page.)

*Primary Examiner*—Gregory M. Vidovich
*Attorney, Agent, or Firm*—Wood, Herron & Evans, L.L.P.

[57] ABSTRACT

A holster assembly for use with a hand-held utility knife having a segmented blade. The holster assembly comprises a plastic holster having a generally hollow interior and a blade well located inside the hollow interior of the holster. The blade well has at least one slot therethrough and a guide leading to the slot for a user to guide an endmost blade segment of a utility knife into engagement with the slot. By simply twisting the knife, a user may break off the endmost blade segment exposing a fresh cutting edge. The used blade segments are collected inside the blade well.

20 Claims, 5 Drawing Sheets

OTHER PUBLICATIONS

Warner Manufacturing Co., *Pro/Snap–Blade Knife,* Packaging and photos, Warner Manufacturing Co. (Date Unknown).

The C–Thru Ruler Company, *Utility Knife,* Packaging, The C–Thru Ruler Company (Date Unknown).

Sherwin–Williams Co., *Snap–Off Knife,* Packaging and photo (Date Unknown).

Greystone, *Retractable Utility Knife and Holder,* Packaging and photos, Greystone Product (Date Unknown).

Do It, *Snap Blade Knife,* Packaging (Date Unknown).

HOLSTER AND BLADE WELL

CROSS REFERENCE TO RELATED APPLICATIONS

This patent application is a continuation-in-part application of U.S. patent application Ser. No. 09/057,744 filed Apr. 9, 1998 entitled Blade Holster Assembly which has matured into U.S. Pat. No. 6,000,590 and which is fully incorporated by reference herein.

FIELD OF INVENTION

This invention relates to the storage of utility knives having segmented disposable blades, and more particularly to an apparatus for storing and holding such a utility knife along with used blade segments resulting from use of the knife.

BACKGROUND OF THE INVENTION

Utility knives adapted to hold segmented blades are known. Such knives are commonly used to cut wallpaper, cardboard or other types of similar products. As the cutting edge of the endmost segment of the blade becomes dull due to repeated use, the endmost blade segment may be snapped off exposing a fresh blade segment having a fresh cutting edge. This process may be repeated until all of the blade segments have been used. The remainder of the blade may be removed from the knife and a replacement blade having multiple unused segments may then be inserted into the knife. This process may be repeated as long as replacement blades are available.

Most of these hand-held utility knives are adapted to retract the segmented blade so that the cutting edge of the endmost segment may be withdrawn into the interior of the knife when the knife is not being used. A knife capable of retracting the blade is generally safer than a knife in which the blade is not retractable. U.S. Pat. Nos. 4,103,421 and 4,226,020 disclose knives having a cutting blade which may be fully or partially retracted and held in such a position.

One difficulty with using a knife with a segmented blade is that with repeated use, the cutting edge of the endmost blade segment will dull. The endmost blade segment must then be broken off from the remainder of the blade. Usually, some sort of tool is necessary to grasp or engage the endmost used blade segment and break it off from the remainder of the blade. Once the endmost blade segment is broken off, it must be discarded safely. Several knives such as the one disclosed in U.S. Pat. No. 4,063,356 have been equipped with a device, often called an end cap, which may be removed from one end of the knife and used to snap off the endmost segment of the blade. Such an end cap usually has a slot therein which is adapted to receive the endmost blade segment. One difficulty with using an end cap to snap off endmost blade segments is that once the endmost blade segment has been broken off from the remainder of the blade, there is no place for the used blade segment to be placed or stored safely. Consequently, the used blade segment may drop onto the floor where it may be picked up by a child or stepped on or otherwise cause harm to someone in the vicinity. Only if the user of such a hand knife is able to maintain pressure on the sides of the end cap while the endmost blade segment is located in the slot of the end cap will the used blade segment not fall away from the end cap onto the floor. If the user is able to hold the used blade segment with the end cap, the user may walk over to a trash can and properly dispose of the used blade segment.

However, often the user is on a ladder or nowhere near a trash receptacle. Therefore, this method of breaking off and disposing used blade segments is not always practical. In addition, it is time consuming and requires a great deal of effort.

Another difficulty with using an end cap to break off an endmost blade segment is that often the user's hands are wet or dirty so, consequently, when trying to snap off the endmost blade segment with the end cap, the user's hands may slip and result in a skin cut. Because the slot in the end cap is relatively narrow, it is difficult to properly line up the slot in the end cap with the endmost blade segment. The user may miss the slot in the end cap, causing the cutting edge of the endmost blade segment to cut the user.

Knives have been developed which are adapted to store used blade segments temporarily. Examples of such knives are disclosed in U.S. Pat. Nos. 5,093,993 and 5,014,429. However, these knives are adapted to house or store a limited number of used blade segments. Additionally, proper disposal of these used blade segments is difficult once the storage space of the knife has been filled.

Another difficulty with using an end cap of a hand knife to break off blade segments is that two hands are required to remove the end cap from one end of the knife and place it over the endmost blade segment at the other end of the knife in order to properly snap off the endmost blade segment. Often when a user is on a ladder or in another such location, two hands are not available because the user must use one hand to hold himself or herself in place for safety purposes.

Therefore, it has been one objective of the present invention to provide a mechanism for holding and storing a utility knife and collecting used blade segments for proper disposal.

It has been a further objective of the present invention to provide an apparatus which is capable of being used with a utility knife having a segmented blade in which the endmost blade segment may be quickly and easily snapped off by the user with the use of only one hand.

It has been a further objective of the present invention to provide an apparatus adapted to store both a hand-held utility knife and a plurality of used blade segments which may be worn by a user comfortably.

SUMMARY OF THE INVENTION

The invention of this application which accomplishes these objectives comprises a holster assembly for use with a hand-held utility knife adapted to hold a segmented blade. Such utility knives take many different forms and are the subject of numerous patents. The invention of this application may be used with many different hand held utility knives. Therefore, the utility knife and the segmented blade form no part of the present invention.

The holster assembly of the present invention has multiple embodiments, all of which are adapted to receive and hold a utility knife having a segmented blade. Each embodiment of the holster assembly comprises a plastic holster having a generally hollow interior adapted to collect used blade segments which have been broken off from the segmented blade of a utility knife. One embodiment of the holster assembly comprises simply a holster having multiple wall portions and a bottom portion, the wall and bottom portions defining a hollow interior adapted to receive and store a utility knife having a segmented blade. One of the wall portions of the holster has a slot through the wall portion whereby an endmost segment of a segmented blade may be placed into the slot and the knife twisted in order to break off the endmost blade segment and expose a fresh, sharp blade edge. The endmost blade segment falls inside the hollow interior of the holster. Upon repetition of this process, multiple used blade segments are collected inside the hollow interior of the holster. Once the hollow interior of the holster is sufficiently full, the holster may be carried to a trash receptacle or other appropriate receptacle where the used blade segments may be properly and safely discarded.

A guide may be formed in the wall portion having the slot therethrough which has a generally inverted V-shaped configuration, the guide narrowing as it approaches the slot. The purpose of this guide is to enable a user to grasp the utility knife with one hand and place the tip of the knife blade against the guide in the wall portion and by pulling upwardly and inwardly move the endmost knife blade segment into engagement with the slot without having to precisely align the endmost blade segment with the slot. The guide enables a user to more quickly and easily find the slot with the endmost blade segment than he or she would be able to without the guide, and to break off the endmost blade segment using only one hand. Although the guide is illustrated and described as being V-shaped, the guide could assume other configurations such as, for example a linear configuration among others.

The holster preferably has a clip secured to a rear wall portion of the holster, enabling the user to secure the holster onto his or her belt, pants or a pocket where it is in a user-friendly position and will not interfere with the ability of the user to work. In addition to a clip, one or more loops may be secured to the rear wall portion of the holster, enabling the user to secure the holster in a more permanent manner to the user's belt. Other securing mechanisms not specifically illustrated and described may be used as well to secure the holster to the user.

Another embodiment of the holster assembly of the present invention comprises a plastic holster having a generally hollow interior and multiple wall portions. The wall portions extend downwardly from a top edge of the holster to an aperture which is adapted to receive and hold a utility knife when the utility knife is not being used. The aperture may be through the bottom portion of the holster or, alternatively, may be interior of the holster.

As with the first embodiment, this embodiment of the holster assembly comprises a holster having a slot through one of the wall portions where an endmost segment of a segmented knife blade may be placed in the slot and the knife twisted in order to break off the endmost blade segment. The endmost blade segment then falls inside the hollow interior of the holster where it is collected to be later properly disposed of. A guide having an inverted V shape is also located in the wall portion and leads up to the slot for guiding the endmost blade segment into engagement with the slot. This embodiment of the holster assembly may also have a blade well located inside the hollow interior of the holster. The blade well may or may not be disposable and functions to collect used blade segments so that they may be contained within a relatively small area. The blade well has a hollow interior and is most often generally rectangular, The blade well may be removably secured to the inner surface of the wall portions of the holster so that it may be quickly and easily removed and emptied or discarded. If the blade well is discarded, a new empty blade well must be inserted in place of the discarded one.

Another embodiment of the holster assembly of the present invention comprises a holster having a generally hollow interior and a blade well. In this embodiment, none of the wall portions of the holster has a slot therethrough nor a guide leading up to the slot. Rather, a blade well having a guide and slot is located inside the generally hollow interior of the holster. The blade well has a generally hollow interior adapted to collect and receive used blade segments. The blade well has at least one sidewall having a slot therethrough whereby an endmost segment of the knife blade may be placed into the slot and the knife twisted in order to break off the endmost segment of the knife blade, the endmost segment falling inside the blade well. The blade well may have a finger loop secured to the top of the blade well whereby a user may lift the blade well away from the holster by inserting a finger into the finger loop and pulling the blade well upwardly. In this manner, the blade well, once full of blade segments, may be removed and either emptied or discarded. An empty blade well may then be inserted into the hollow interior of the holster and the process repeated. The sidewall of the blade well having the slot therethrough may also have an inverted V-shaped guide formed in the sidewall, the inverted V-shaped guide narrowing in a direction toward the slot. Such a V-shaped guide functions to guide the endmost segment of the knife blade into engagement with the slot thus making it easier for a user to break off the endmost blade segment.

The blade well also may have a slot formed through the top of the blade well. This second slot enables a user to choose between engaging the endmost blade segment of the utility knife with either the slot through the sidewall of the blade well or the slot through the top of the blade well in order to break off the endmost blade segment.

With any of the embodiments of the holster assembly described hereinabove, the holster may further comprise a storage compartment secured to the holster. The storage compartment may either be integrally formed with the holster and extend outwardly from the outside surface of one of the wall portions of the holster or may be separately formed and attachable-to one of the wall portions of the holster. The storage compartment functions to safely store additional segmented blades which may be inserted into the knife once the blade in the knife is worn out due to use and all of the segments broken off. The storage compartment may have a cap hingedly connected to the storage compartment which may be lifted in order to remove one or more unused blades from the storage compartment.

The blade well may have at least one groove therein adapted to receive at least one track protruding from the inner surface of one of the wall portions of the holster in order to removably secure the blade well inside the hollow interior of the holster and prevent the blade well from moving therein.

In each of these embodiments the holster assembly may be worn by a user in a position where it will not interfere with the user's ability to work with a hand-held utility knife. In addition, the holster assembly provides a storage device for collecting and storing used blade segments. A slot and guide in the storage device enables a user to engage the endmost blade segment of the utility knife with the slot and simply twist the utility knife in order to break off the endmost blade segment. This is a relatively easy method of breaking off the endmost used blade segment. The user does not have to use two hands to break off an endmost blade segment. These and other objects and advantage of the present invention will be more readily apparent from the following description of the drawings.

DETAILED DESCRIPTION OF THE DRAWINGS

Figure 1:
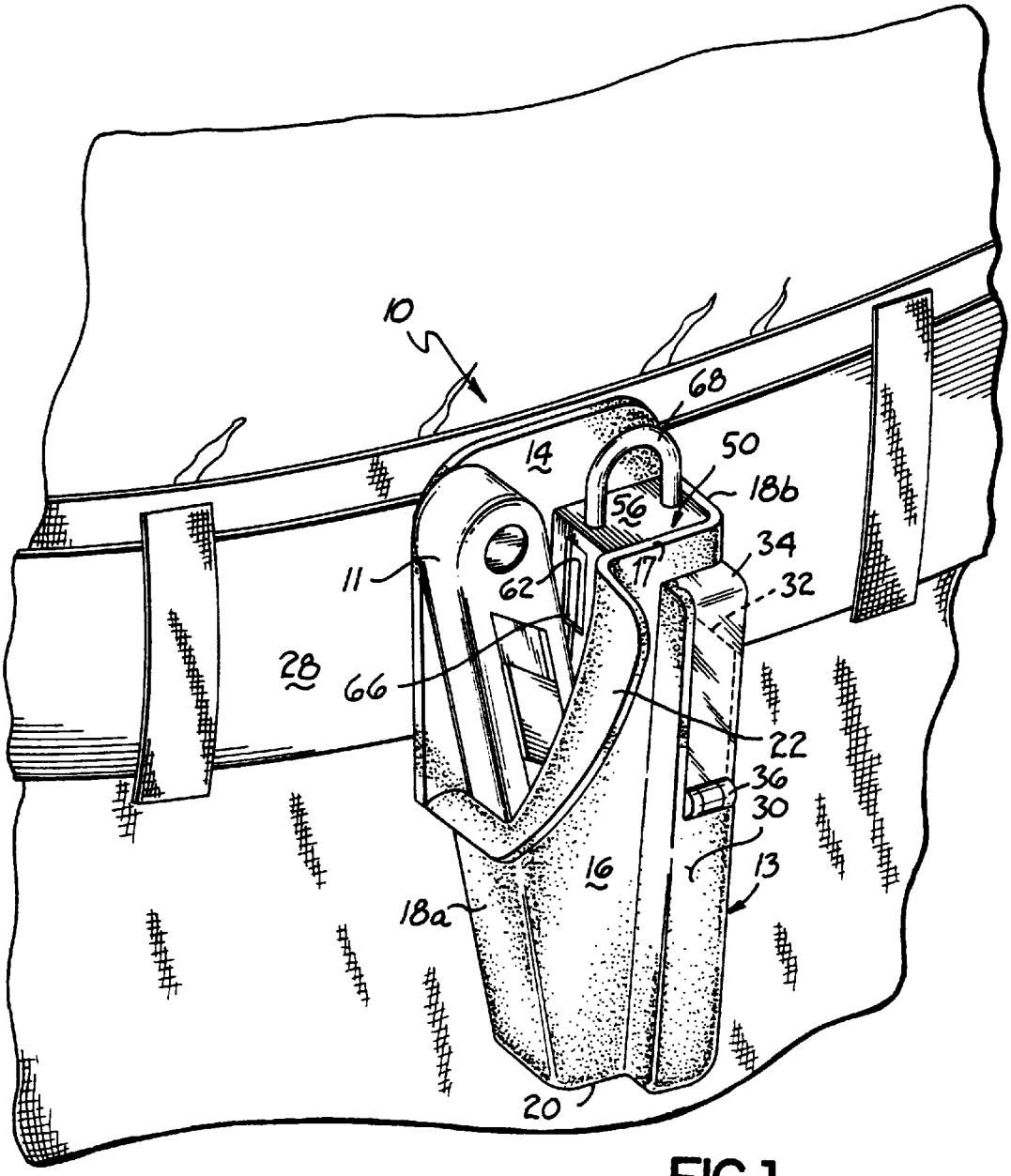
FIG. 1 is a perspective view of the holster assembly of the present invention secured to a user's belt, the holster assembly holding a utility knife therein.
Figure 6A:
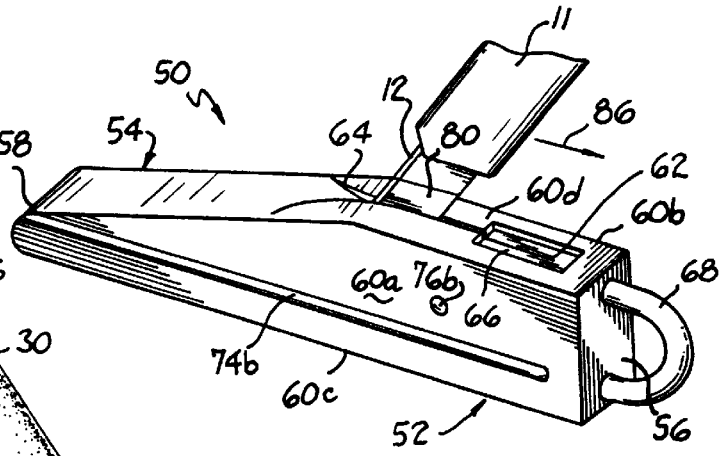
FIG. 6A is a perspective view of a utility knife having an endmost blade segment engaged with a guide formed in one of the sidewalls of the blade well to lead the endmost blade segment into engagement with a slot in the sidewall of the blade well.
Figure 6B:
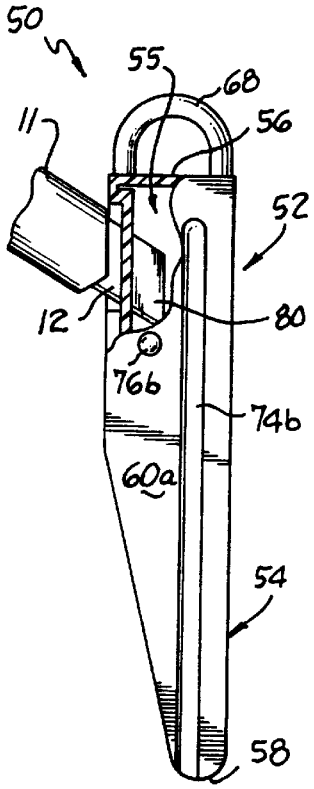
FIG. 6B is a perspective view of the endmost blade segment of the utility knife of FIG. 6A being inserted through a slot formed in a sidewall of the blade well.
Figure 6C:
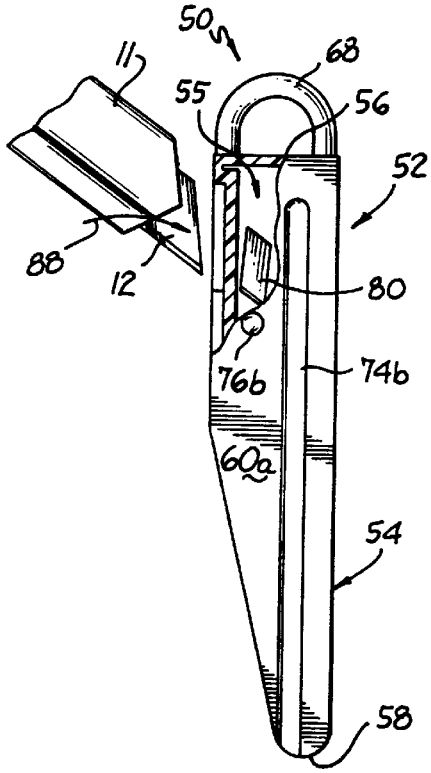
FIG. 6C is a perspective view of the utility knife of FIG. 6A being twisted in order to break off the endmost blade segment, the endmost blade segment falling inside the interior of the blade well.

Referring to the drawings and particularly to FIG. 1, there is illustrated a holster assembly 10 to be used with a hand-held utility knife 11 adapted to hold and receive a segmented blade 12 (see FIGS. 6A–6C). Such utility knives are common and typically used to cut wall paper, carpet and other similar items. The invention of this application may be used with any type of utility knife adapted to hold and receive a segmented blade including utility knifes having clips for securing the utility knife to one's clothing.

The holster assembly 10 comprises a holster 13 which is typically plastic but may alternatively be made of other materials. The holster 13 is preferably made of one piece of molded plastic but may be alternatively made of multiple pieces. The holster 13 has a generally planar rear wall portion 14, a front wall portion 16 and two side wall portions 18*a*, 18*b*. All of the side wall portions are connected with a bottom portion 20 which is generally planar. A lip 22 extends forwardly from the front wall portion 16 and is used to guide a utility knife into the holster. The front, rear and side wall portions 16, 14, 18*a*, 18*b* and bottom portion 20 defined a hollow interior 24 of the holster. The hollow interior 24 of the holster is adapted to receive and hold the utility knife 11 as seen in FIG. 1.

Figure 2:
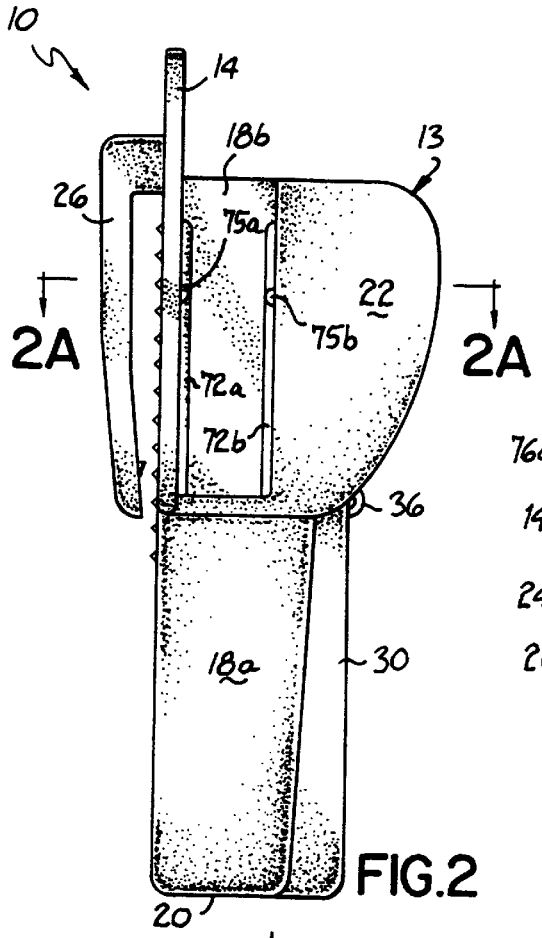
FIG. 2 is a side elevational view of the holster of the holster assembly of FIG. 1.
Figure 8:
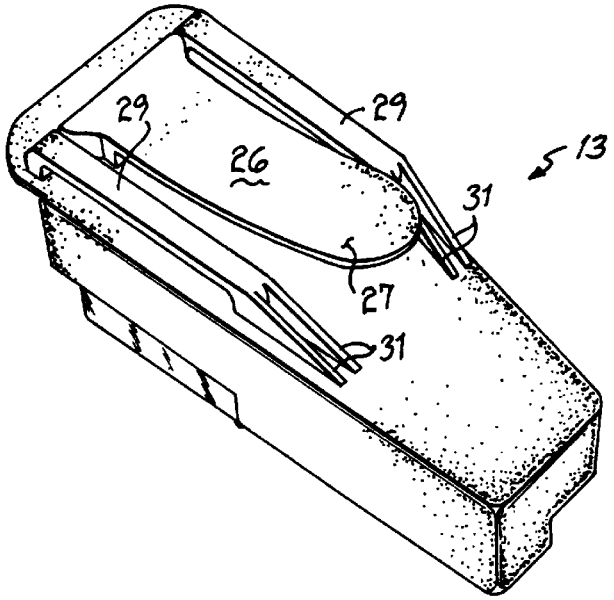
FIG. 8 is a perspective view of an alternative embodiment of the holster assembly, the holster having a pair of belt loops and a clip.

As best seen in FIGS. 2 and 8, the holster 13 may have a resilient clip 26 secured to the rear wall portion 14 of the holster 13 which is adapted to secure the holster to a user. The clip 26 has a lower portion 27 which may be bent inwardly toward the holster as seen in FIG. 2 or flared outwardly away from the rear wall portion 14 of the holster 13 as shown in FIG. 8. Additionally, the holster may have a pair of belt loops 29 used to secure the holster to a user's belt (see FIG. 8). As seen in FIG. 1, either the clip 26 or the belt loops 29 may engage a user's belt 28. The clip 26 is preferably used in order to quickly and easily secure the holster assembly 10 to the user. If a more permanent securement is desired, the user may pass the belt 28 through the belt loops 29. The clip 26 may additionally be used to secure the holster to a user's pocket, to the top of a user's pants, to a tool belt or to any other item secured to the user. A pair of tapered elements 31 lead up to each of the belt loops 29 in order to aid the user in engaging the clip 26 with the user's belt, pants or pocket. The tapered elements 31 are illustrated as being ribs but may be any other tapered structure.

Figure 8A:
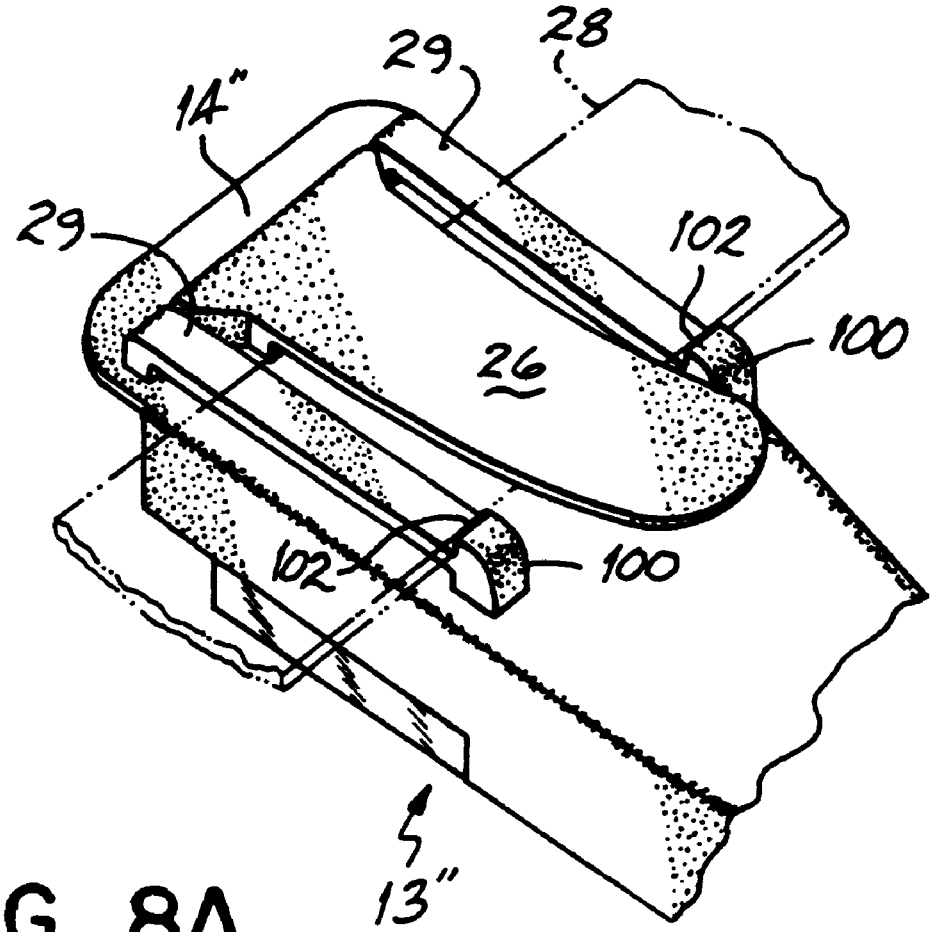
FIG. 8A is a perspective view of an alternative embodiment of the holster assembly, the holster having lower ledge elements.

As illustrated in FIG. 8A, a pair of lower ledge elements 100 may be secured to the rear wall portion 14" of the holster 13" at the bottom of belt loops 29. The lower ledge elements 100 are adapted to secure and support a belt 28 between the belt loops 29 and the clip 26. Each lower ledge element 100 has a generally planar ledge 102 on which the belt 28 rests. The lower ledge elements 100 prevent the belt 28 from sliding away from underneath the clip 26. Although this embodiment of holster 13" has both belt loops 29 and clip 26, the lower ledge elements 100 may also be used on the back of a holster having only a clip, the belt loops being omitted. With no belt loops, the belt rests upon the lower ledge elements and is sandwiched between the rear wall portion of the holster and the resilient clip.

Figure 3:
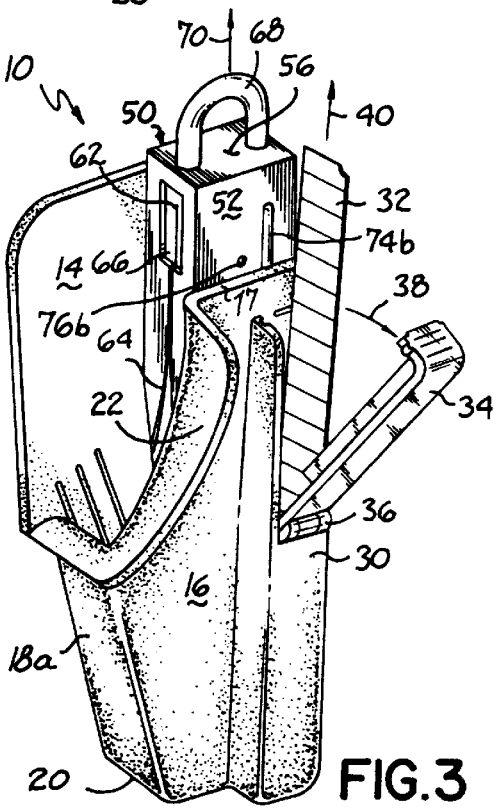
FIG. 3 is a perspective view of the holster assembly of FIG. 1 with the blade well of the holster assembly being removed and an unused blade being removed from a storage compartment of the holster.
Figure 4:
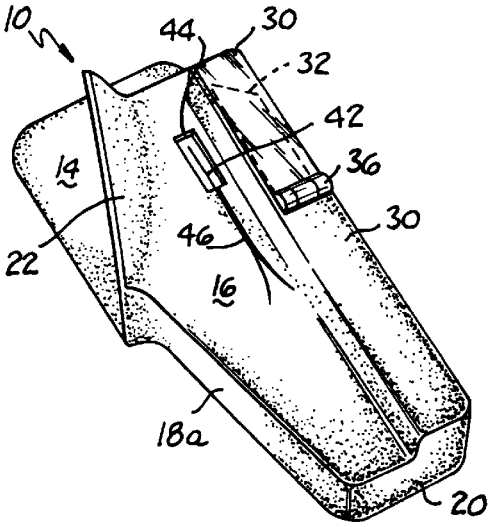
FIG. 4 is a perspective view of an alternative embodiment of the holster assembly of the present invention.

The holster 13 may have a storage compartment 30 extending forwardly from the front wall portion 16 of the holster. The storage compartment 30 may be integrally formed with the holster as illustrated in FIGS. 1, 3 and 4, or alternatively, may be a separate element secured to the holster. Although one configuration of storage compartment 30 is illustrated, the storage compartment may assume numerous other configurations. Additionally, the storage compartment 30 may be located anywhere on the holster. It need not extend forwardly from the front wall portion 16 of the holster. The storage compartment 30 is preferably adapted to hold a plurality of unused blades 32 (see FIG. 3) but may hold other items such as a utility knife. The storage compartment 30 may have a cap 34 hingedly connected to the storage compartment with hinge 36 (see FIGS. 3 and 4). However, the storage compartment 30 need not have a hinged cap 34; rather it may have an open top. In order to pull out a replacement blade when the blade of a utility knife is entirely used or spent, a user simply pulls the cap 34 forwardly in the direction of arrow 38 in order to expose the unused blades 32. One of the unused blades 32 is then pulled upwardly in the direction of arrow 40 and placed in a utility knife so that the utility knife may be used with a fresh blade. This process is repeated as long as there are available unused blades 32 in the storage compartment 30.

The holster assembly of the present invention has multiple embodiments, the simplest of which is illustrated in FIG. 4. In this embodiment, the holster 13 has a slot 42 formed in the front wall portion 16 of the holster. The slot 42 may be surrounded by a generally rectangular recessed area 44. This recessed area 44 may be any shape and need not be present for the invention to function properly. Additionally, a guide 46 is integrally formed in the front wall portion 16 of the holster and leads upwardly to the slot 42. The guide 46 has an inverted V-shaped configuration such that a user may engage the endmost blade segment of the knife with the bottommost portion of the guide which is the widest and move the knife upwardly until the endmost blade segment engages the slot 42. The knife is then twisted so as to break off the endmost blade segment, the endmost blade segment falls inside the hollow interior 24 of the holster 13 and a new cutting edge is exposed on the knife blade. Although the guide 46 is illustrated as being below the slot 42, the guide may alternatively be located above the slot 42. The slot 42 may be any length and may extend into the guide 46.

Once broken off, the used blade segments collect inside the hollow interior of the holster. When the user desires to discard the used blade segments, the user may remove the holster from his or her person (i.e., belt or pants), walk over to a proper trash receptacle and empty the interior of the holster into the trash receptacle. In this manner, unless the user turns the holster upside down, the holster will collect multiple used blade segments preventing them from falling on the floor or otherwise being lost such that they could cause injury to someone in the vicinity.

An alternative embodiment of the holster assembly of the present invention is illustrated in FIGS. 1–3. This embodiment of the holster assembly comprises a holster 13 and a blade well 50. In this embodiment, the holster 13 does not have a slot or a guide integrally formed in the holster. As best seen in FIG. 3, the blade well 50 is located inside the generally hollow interior 24 of the holster 13. Inside the generally hollow interior 24 of the holster 13, the blade well 50 preferably extends upwardly from the bottom portion 20 of the holster 13 to an upper edge 17 of the front wall portion 16 of the holster 13. As best seen in FIGS. 6A–6C, the blade well 50 has a generally rectangular upper portion 52, a tapered lower portion 54 and a hollow interior or storage area 55. The hollow interior or storage area 55 functions to store used blade segments. The blade well 50 is preferably a one piece molded unit having a top 56, a bottom 58 (see FIG. 6A), and four sidewalls 60*a*–60*d*. However, the blade well 50 may be made of multiple pieces and may be made of any material. As best seen in FIG. 6A, one of the sidewalls 60*d* has a slot 62 therethrough and an inverted V-shaped guide 64 leading up to the slot. A generally rectangular recessed portion 66 surrounds the slot 62 and makes inserting the endmost blade segment into the slot 62 easier than if it were not there. A finger loop 68 extends upwardly from the top 56 of the blade well 50 and enables a user to put his or her finger in the finger loop 68 and lift upwardly in the direction of arrow 70 in order to remove the blade well 50 from the holster 13 (see FIG. 3).

Figure 7:
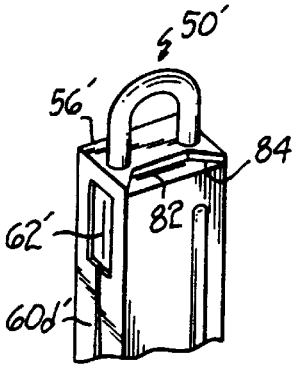
FIG. 7 is a fragmentary perspective view of an alternative embodiment of the blade well.

An alternative embodiment of blade well is illustrated in FIG. 7. This embodiment of the blade well 50' of the present invention has a second slot 82 formed through the top wall 56' of the blade well 50'. A recessed area 84 is located in front of the second slot 82. The recessed area 84 aids the user in guiding the endmost blade segment into the second slot 82. The existence of the second slot 82 in the blade well 50' gives the user the choice of using the first slot 62' formed through the sidewall 60*d'* or the second slot 82 formed through the top wall 56' of the blade well 50'.

Figure 2A:
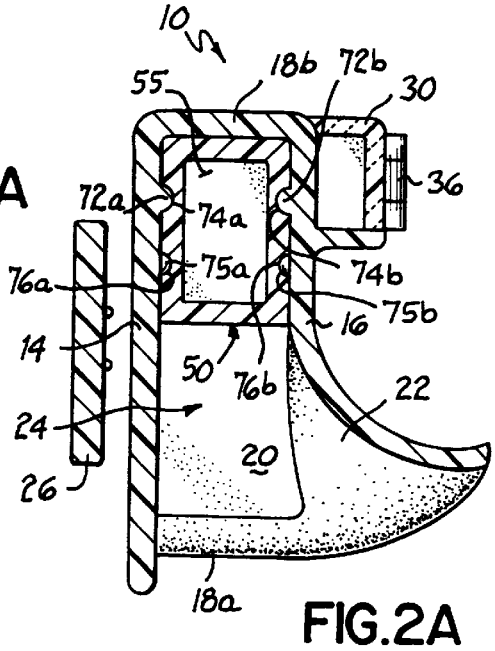
FIG. 2A is a view taken along the lines 2A—2A of FIG. 2.

Referring now to FIGS. 2A and 3, the blade well 50 is prevented from moving inside the hollow interior 24 of the holster 13 by two tracks 72*a*, 72*b* extending inwardly from the inner surface of the front and rear wall portions 16, 16 of the holster 13. The tracks 72*a*, 72*b* are adapted to engage two grooves 74*a* and 74*b* formed in sidewalls 60*a* and 60*b* of the blade well 50. This groove and track arrangement prevents the blade well 50 from laterally moving inside the hollow interior 24 of the holster and ensures that there is adequate room for the user to place a utility knife inside the hollow interior 24 of the holster. Additionally, there are two dimples 75*a*, 75*b* extending inwardly from the inner surface of the front and rear wall portions of the holster (see FIG. 2A). These dimples 75*a*, 75*b* are adapted to engage two recesses 76*a*, 76*b* formed in the sidewalls 60*a*, 60*b* of the blade well. When the dimples 75*a*, 75*b* are engaged with the recesses 76*a*, 76*b*, the blade well 50 is held in place vertically inside the hollow interior 24 of the holster. Only with sufficient force exerted by the user on the finger loop of the blade well may the blade well 50 be pulled upwardly away from the hollow interior 24 of the holster.

This embodiment of the blade well may or may not be disposable. Although not illustrated, the blade well may have a removable portion enabling a user to empty the contents, i.e. used blade segments, from inside the hollow interior of the blade well and reuse the blade well. Alternatively, the blade well may be discarded and a new blade well inserted.

Figure 5:
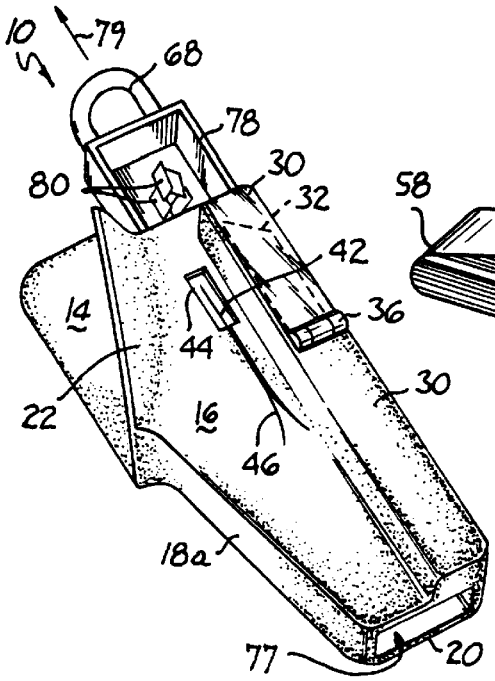
FIG. 5 is a perspective view of yet another alternative embodiment of the holster assembly of the present invention.

FIG. 5 illustrates yet another embodiment of the holster assembly of the present invention. The holster of this embodiment 13 has a slot 42 and guide 46 similar to those of the embodiment of FIG. 4. The holster is identical to the holster 13 of FIG. 4 except an aperture 77 is located through the bottom portion 20 of the holster. The aperture 77 is sized so as to receive a utility knife and hold the utility knife in place. This embodiment of the holster assembly has a different blade well 78. This blade well 78 is similar to the blade well 50 of the embodiment shown in FIGS. 1 and 3 except that one of the sidewalls of the blade well is missing so the blade well 78 has an open side which faces toward the front wall portion 16 of the holster. Although not specifically shown, this embodiment of blade well may have at least one guide adapted to receive at least one track extending outwardly from the inner surface of at least one wall portion of the holster. In use, the user simply engages the endmost blade segment of the knife with the slot in the front wall portion of the holster and once snapped-off, the used blade segment falls inside the blade well 78. When the user wishes to discard the used blade segments, he or she simply lifts upwardly on the finger loop 68 of the blade well 78 in the direction of arrow 79. Once the blade well 78 is emptied, it may be again inserted into the hollow interior of the holster. The blade well 78 may or may not have the groove and track arrangement described hereinabove.

Referring now to FIGS. 6A–6C, the method by which the endmost blade segment of a utility knife is broken off using the guide and slot arrangement of the present invention will be described in detail. Referring to FIG. 6A, the endmost blade segment 80 of blade 12 is brought into engagement with guide 64. The endmost blade segment 80 is pulled upwardly in the direction of arrow 86 along the guide 64 until the endmost blade segment reaches the slot 62. The endmost blade segment 80 then passes through the slot 62 as seen in FIG. 6B. The knife 11 is then twisted (see arrow 88) in order to break off the endmost blade segment, as illustrated in FIG. 6C. The endmost blade segment 80 then falls downwardly inside the hollow interior of the blade well exposing a new unused cutting surface of the blade. The guide and slot formed in the holster work in the same manner.

Figure 9:
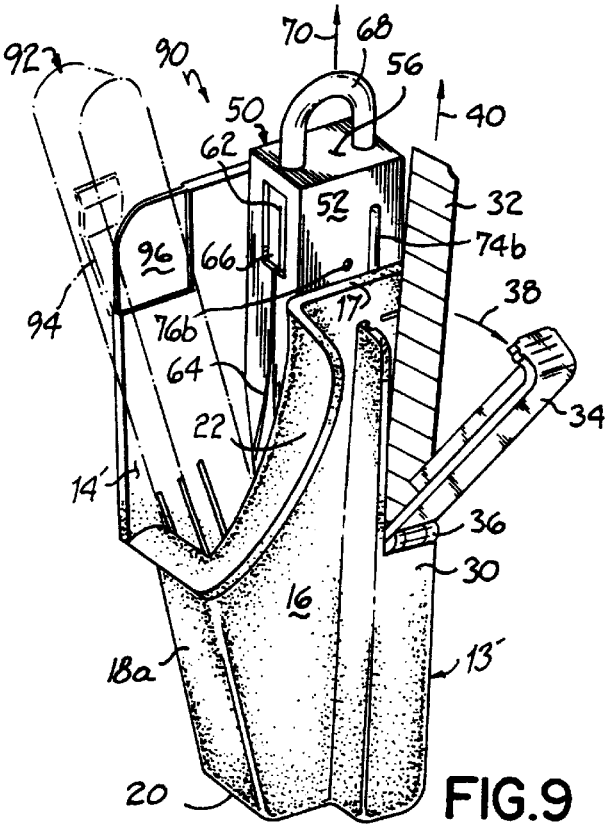
FIG. 9 is a perspective view of an alternative embodiment of holster with the rear wall portion of the holster being adapted to receive a particular configuration of utility knife having a clip.
Figure 10:
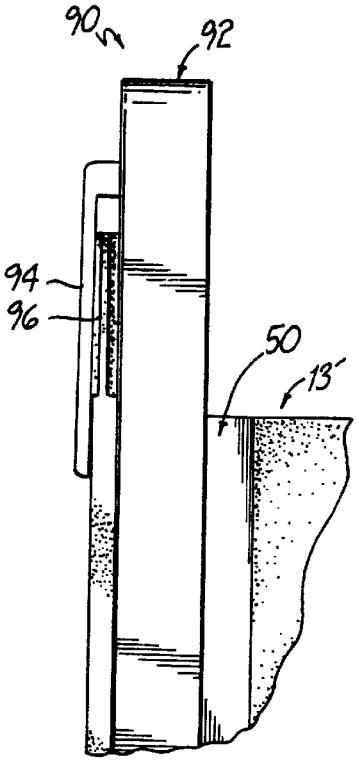
FIG. 10 is a side elevational view of the holster assembly of FIG. 9 with the utility knife engaged with the rear wall portion of the holster.

Although any type of utility knife adapted to hold and receive a segmented blade may be used in accordance with the present invention, FIGS. 9 and 10 illustrate an embodiment of holster assembly 90 configured for use with a particular configuration of utility knife 92. The utility knife 92 has a clip 94 for securing the utility knife 92 to the holster 13'. The holster 13' has a rear wall portion 14' which has a receiving portion 96 adapted to receive and retain the utility knife 92. The receiving portion 96 is thinner than the remainder of the rear wall portion 14' of the holster 13'. The clip 94 of the utility knife 92 fits over the receiving portion 96 of the rear wall portion 14' of the holster 13' and releasably secures the utility knife 92 to the rear wall portion 14' of the holster 13'.

Although the holster assembly of the present invention has been described as being secured to a user, the holster assembly may be adapted to be mounted on a ladder or to a desk or other fixture. Additionally, the holster assembly may be adapted for use by either a left or right handed individual.

Thus, the present invention enables a user to snap off an endmost blade segment of a hand-held utility knife using only one hand more safely and efficiently than has been heretofore possible. Further, the used blade segments may be collected and properly discarded without the risk of used blade segments falling on the floor or otherwise being misplaced to locations in which they may cause harm or injury.

While I have described several embodiments of the present invention, persons skilled in the art will appreciate changes and modifications which may be made without departing from the spirit of this invention. Therefore, I do not intend to be limited except by the scope of the following claims.

What is claimed is:

1. A holster assembly for use with a utility knife having a segmented blade, said holster assembly comprising:

a blade well having at least one sidewall, said at least one sidewall having a first slot therethrough whereby an endmost segment of the knife blade is selectively placed into the first slot and the knife twisted in order to break off the endmost segment of the knife blade, the endmost segment falling inside said blade well, a holster having an open top and a generally hollow interior adapted to receive and hold said utility knife, a portion of said hollow interior being complementarily configured to receive said blade well, wherein the utility knife is removable through said open top of said holster without removal of said blade well.

2. The holster assembly of claim 1 wherein said blade well has a top, said top of said blade well having a second slot therethrough.

3. The holster assembly of claim 1 further comprising an inverted V-shaped guide formed in said at least one sidewall of said blade well, said inverted V-shaped guide narrowing in a direction toward the first slot.

4. The holster assembly of claim 1 further comprising a storage compartment secured to said holster.

5. The holster assembly of claim 4 wherein said storage compartment is integrally formed with said holster.

6. The holster assembly of claim 4 further comprising a cap hingedly connected to said storage compartment.

7. The holster assembly of claim 1 further comprising a pair of belt loops for attaching said holster to a user.

8. The holster assembly of claim 1 wherein said holster has at least one track and said blade well has at least one groove, said at least one track of said holster being adapted to receive said at least one groove of said blade well.

9. A holster assembly for use with a utility knife adapted to hold a segmented blade, said holster assembly comprising:

a blade well having a hollow interior, at least one sidewall and a top, at least one of said at least one sidewall and said top having a slot therethrough whereby an endmost segment of the knife blade is selectively placed into the slot and the knife twisted in order to break off the endmost segment of the knife blade, the endmost segment failing inside said hollow interior of said blade well, a holster having an open top and a generally hollow interior adapted to receive and hold the utility knife, a portion of said hollow interior being complementarily configured to receive said blade well, wherein the utility knife is removable through said open top of said holster without removal of said blade well.

10. The holster assembly of claim 9 wherein said holster has a lip extending forwardly from a front wall portion of said holster for guiding said utility knife into said generally hollow interior of said holster.

11. The holster assembly of claim 9 wherein said holster has at least one track adapted to engage at least one groove formed in said at least one sidewall of said blade well.

12. The holster assembly of claim 9 further comprising a finger loop secured to said blade well, whereby a user may lift said blade well away from said holster by inserting a finger in said finger loop and pulling said blade well upwardly.

13. The holster assembly of claim 9 further comprising a clip and a pair of belt loops for securing said holster to a user.

14. The holster assembly of claim 13 further comprising tapered elements leading up to said belt loops.

15. The holster assembly of claim 9 wherein said holster has a storage compartment.

16. A holster assembly adapted to be used with a utility knife having a segmented blade, said holster assembly comprising:

a holster having an open top, a front wall portion, a rear wall portion, a pair of side wall portions and a bottom portion defining a hollow interior of said holster, said hollow interior of said holster being adapted to receive and hold the utility knife, said holster having at least one track formed therein, a blade well located inside the hollow interior of the holster, said blade well having sidewalls, at least one of said sidewalls having a first slot therethrough whereby an endmost segment of the utility knife blade is inserted into the first slot and the utility knife twisted in order to break off the endmost segment of the knife blade, the endmost segment of the knife blade falling inside said blade well, at least one of said sidewalls of said blade well having at least one groove adapted to engage said at least one track of said holster in order to prevent said blade well from laterally moving inside said hollow interior of said holster.

17. The holster assembly of claim 16 further comprising an inverted V-shaped guide formed in said at least one sidewall, said inverted V-shaped guide narrowing in a direction toward the first slot.

18. The holster assembly of claim 16 further comprising a pair of belt loops secured to said rear wall portion of said holster.

19. The holster assembly of claim 16 wherein said blade well has a top and a bottom, said top having a second slot therethrough.

20. The holster assembly of claim 16 further comprising a clip located between said belt loops.

* * * * *